US006529132B2

(12) United States Patent
Boucourt

(10) Patent No.: US 6,529,132 B2
(45) Date of Patent: Mar. 4, 2003

(54) DEVICE FOR MONITORING AN ENCLOSURE, IN PARTICULAR THE HOLD OF AN AIRCRAFT

(75) Inventor: Gerard Boucourt, Rouffiac Tolosan (FR)

(73) Assignee: Societe Industrielle d'Avation Latecoere, Toulouse (FR)

( * ) Notice: Subject to any disclaimer, the term of this patent is extended or adjusted under 35 U.S.C. 154(b) by 0 days.

(21) Appl. No.: 09/986,400

(22) Filed: Nov. 8, 2001

(65) Prior Publication Data

US 2002/0030608 A1 Mar. 14, 2002

Related U.S. Application Data

(63) Continuation of application No. 09/622,641, filed as application No. PCT/FR99/00446 on Feb. 26, 1999.

(30) Foreign Application Priority Data

Feb. 27, 1998 (FR) ..... 98 02653

(51) Int. Cl.[7] ..... G08B 19/02
(52) U.S. Cl. ..... 340/583; 340/580; 250/339.11
(58) Field of Search ..... 340/511, 514, 340/577, 578, 580, 604, 583; 250/330, 339.05, 339.1, 341.6, 342, 339.11, 339.12, 341.8; 374/5, 124, 137; 348/156, 164, 143

(56) References Cited

U.S. PATENT DOCUMENTS

| | | | | | |
|---|---|---|---|---|---|
| 3,816,654 | A | * | 6/1974 | Brightman | 348/156 |
| 4,614,968 | A | | 9/1986 | Rattman et al. | 348/143 |
| 4,816,828 | A | * | 3/1989 | Feher | 340/945 |
| 5,005,005 | A | * | 4/1991 | Brossia et al. | 340/604 |
| 5,085,525 | A | | 2/1992 | Bartosiak et al. | 374/124 |
| 5,111,048 | A | * | 5/1992 | Devitt et al. | 250/342 |
| 5,153,722 | A | * | 10/1992 | Goedeke et al. | 340/511 |
| 5,500,530 | A | * | 3/1996 | Gregoris | 340/583 |
| 5,936,245 | A | * | 8/1999 | Goillot et al. | 250/330 |
| 6,037,976 | A | * | 3/2000 | Wixson | 348/122 |

FOREIGN PATENT DOCUMENTS

| | | |
|---|---|---|
| DE | 38 12 560 A1 | 10/1989 |
| DE | 195 42 481 C1 | 2/1997 |
| EP | 0 178 015 A | 4/1986 |
| EP | 0 731 418 A2 | 9/1996 |
| EP | 0 818 766 A1 | 1/1998 |
| GB | 2 250 090 A | 5/1992 |

* cited by examiner

*Primary Examiner*—Van Trieu
(74) *Attorney, Agent, or Firm*—Oliff & Berridge, PLC

(57) ABSTRACT

This device comprises at least one sensor of a CCD camera of very short spectral band lying between 0.4 $\mu$m and 1.1 $\mu$m, fitted with an infrared filter eliminating the spectral band lying between around 0.4 $\mu$m and 0.8 $\mu$m, this sensor being associated with a computer catering in particular for image processing, at least one display screen and a control board. It is thus possible, with the aid of a single type of sensor, to detect hot spots, flames, smoke and the shifting of objects, and to provide a visualization of the inside of the enclosure.

15 Claims, 2 Drawing Sheets

DEVICE FOR MONITORING AN ENCLOSURE, IN PARTICULAR THE HOLD OF AN AIRCRAFT

This is a Continuation of application Ser. No. 09/622,641 filed Oct. 12, 2000, now is abandoned which in turn is a U.S. National Stage of International Application Ser. No. PCT/FR99/00446, filed on Feb. 26, 1999. The entire disclosure of the prior application(s) is hereby incorporated by reference herein in its entirety.

BACKGROUND OF THE INVENTION

1. Field of the Invention

The subject of the present invention is a device for monitoring an enclosure, in particular the hold of an aircraft.

2. Description of Related Art

The hold of an aircraft contains containers or objects which are moored to the floor, so as to be immobilized during the movement, in particular the flight, of the aircraft. It is advisable to ensure that, in the course of the movement of the aircraft, there is no movement of the containers or other objects inside the hold, such movement possibly resulting in damage to the structure of the aircraft with damaging consequences.

It is also important to be able to continuously monitor the hold of an aircraft so that the crew can immediately be warned in the event of the appearance of smoke, a fire, or a hot spot resulting, for example, from an electrical short circuit.

Hitherto, these various requirements have been fulfilled to a greater or lesser degree with the aid of various types of sensor. There are optical sensors or ion sensors, which essentially detect smoke by measuring any opacity between an emitter and a receiver. The number of sensors required to fit out a hold in this way is very, but this does not deliver a perfect result, insofar as the smoke detections are performed belatedly and these detectors are sensitive to the environment (pressure, humidity, dust), giving rise to false alarms, which nevertheless require that the aircraft return to the airport. It is also known practice to use video cameras of CCD type, which operate in the near infrared and are associated with an image-processing computer, with a monitor in the cockpit of the aircraft, for displaying the hold of the craft.

The drawbacks of the known systems are:

- the point-like nature of the detections of fires, smoke and hot spots, giving no details regarding the volume coverage, the shape factor of the fire or of the smoke, the geographical density of the smoke or the displaying of the distribution of the hot spots;
- the various detection systems are separate, requiring as many computers as types of detection as well as a large number of sensors, since the latter are all specific to one type of detection;
- the known systems give no details regarding the movement of the loads contained in the hold and regarding any impairment to the aircraft resulting from the shifting of such loads.

It would be possible to make temperature measurements with the aid of infrared thermographic cameras. Such cameras are very big, their spatial resolution is low, and their cost very high. This solution is therefore not implemented.

Monitoring cameras with an infrared projector and elements which are sensitive to this type of radiation are already known, for example from documents DE 19542481C1 and DE 3812560A1, or else U.S. Pat. No. 5,085,525, but these are essentially fixed cameras envisaged for use outdoors and not designed for the monitoring of a closed enclosure, and in particular an aircraft hold subjected to vibrations, accelerations, temperatures and other more or less severe conditions. Moreover, these documents limit themselves to the description of cameras, constituting sensors, without truly describing a complete system together with processing of the signals delivered by these sensors.

SUMMARY OF THE INVENTION

The object of the invention is to provide a device for monitoring an in particular, in particular the hold of an aircraft, which makes it possible with the aid of a single type of sensor of simple design and of a single type of computer, to accomplish several functions for detecting fires, smoke, hot spots, movements of load, and for visualization of the enclosure, in particular the hold of an aircraft.

To this end, the monitoring device to which it relates comprises at least one sensor consisting of a CCD camera of very short spectral band lying between 0.4 $\mu$m and 1.1 $\mu$m, fitted with an infrared filter eliminating the spectral band lying between around 0.4 $\mu$m and 0.8 $\mu$m, this sensor being associated with a computer catering in particular for image processing, by means of a display screen and a control board.

This type of video camera can detect hot spots, for temperatures lying between around 350 and 600° C., corresponding to the spectral band lying between 0.8 and 1.1 $\mu$m.

Advantageously, each camera is associated with a near infrared lighting element, each lighting element consisting, for example, of an 880 nm silicon element.

According to another characteristic of the invention, each camera and the associated lighting element are housed inside a sealed box closed by a porthole. It is interesting to note that, in the spectral band of the CCD camera, the spectral transmission factor of the porthole is a constant which depends only on the thickness of the material traversed. Insofar as each camera is associated with one lighting element, the camera makes it possible to perform other types of detection, especially detections of fires, smoke or movements of load, and to display the enclosure within which this camera is placed. This device is advantageous in the sense that all the sensors are of the same kind and are associated with one and the same computer and with one and the same control board.

According to another characteristic of the invention, the box also contains a temperature-regulating device and/or a device for de-icing the porthole, as well as a supply, command and control block.

The device can thus operate in various environments, especially under variable humidity, pressure and temperature conditions, without these conditions affecting its reliability.

As far as the lighting is concerned, it is not continuous, since the computer brings about the lighting of each lighting element for durations, for example, of between around 40 and 100 milliseconds. It is thus possible to procure results delivered by each camera, without lighting, for example for thermographic measurements or certain measurements of fire, and the measurements requiring lighting, such as the measurements of the presence of smoke, of movements of the load, or of displaying of the inside of the hold. The images may be acquired with greater or lesser integration times.

According to one characteristic, this device compares two images, one of which constitutes a reference image, which are acquired successively so as to detect variations in the position of the objects lying in the field of each camera. It is thus possible to detect the movement of a load, based on a comparison of images. In the case of an aircraft hold, the image of the load forming the reference is stored before the craft takes off, a real-time comparison of the image of the hold relative to the reference image during the flight, making it possible to detect geographical variations of the load and to pinpoint and measure these variations. The system allows a resolution determining a shifting of the load relative to the hold of a value of 50 mm to 15 m with a horizontal angle of 30°.

The device also allows the pinpointing, in three dimensions, of an object of the scene, using <<monocular>> vision, provided that the object is furnished with a locating pattern. It also makes it possible, by this means, to dynamically track the object within the scene. To this end, an autocalibration of detection on a plane locating pattern is carried out, this locating pattern being known by the system. The following parameters are extracted from the calibration: geometrical distortion, focal length, style of pixel discretization, optical centre. Automatic extraction of the points of the locating pattern is carried out, together with correction of the distortion on the basis of the parameters and matching of the distorted points with the object model, and finally pinpointing (translation, rotation, hence distance from the object to the camera) on the basis of the previous steps.

Regardless of the process used to pinpoint the objects and to detect their movements, the device is rendered insensitive to interfering phenomena of the vibration type.

Furthermore, this device analyses the histogram of the grey levels of an image provided by a camera with counting of the points having a level higher than a predetermined threshold and forming a connected region of the image, so as to deduce therefrom the existence and the extent of a zone of fire. A detection is triggered upon variation of the histogram of the image, from which is deduced, on the one hand, the extent of the zone of fire by counting the minimum number of continuous pixels of the image and, on the other hand, the level of the points of the zone of fire, that is to say the minimum threshold on the various pixels, by performing a discrimination of the interfering phenomena, such as those resulting from the sun or from an incandescent lamp.

Furthermore, this device analyses the distribution of the grey levels as well as the number of classes present in each image delivered by a camera so as to detect the possible presence of smoke.

The detection of smoke is based on pinpointing in the image a rise in luminosity related to the opacity of the smoke, given that this image is delivered while the lighting element is operating. Detection is triggered by variation of the histogram of the image, from which one deduces the mean degree of opacity which gives rise to a percentage heightening of the image, due to the diffusion of light and the extent of the smoke zone. The fog/smoke discrimination is carried out with the aid of a hygrometric sensor situated in the enclosure, or by analysing the spatio-temporal gradient of diffusion, given that the gradient of the change in transmission of smoke is small, whereas the transmission gradient in fog is large.

The computer is linked to at least one alarm to which a signal is delivered upon detection of an anomaly. When monitoring the hold of an aircraft, the crew of the latter can, in the event of detection actioning an alarm, and by virtue of the screen, use the device as a display device allowing a view of the inside of the hold, so as to check whether this detection is justified and does not result from an operating fault.

BRIEF DESCRIPTION OF EXEMPLARY EMBODIMENTS

At any rate, the invention will be better understood with the aid of the description which follows, with reference to the appended diagrammatic drawing representing, by way of non-limiting example, an embodiment of this device:

DETAILED DESCRIPTION OF THE EXEMPLARY EMBODIMENT

Figure 1:
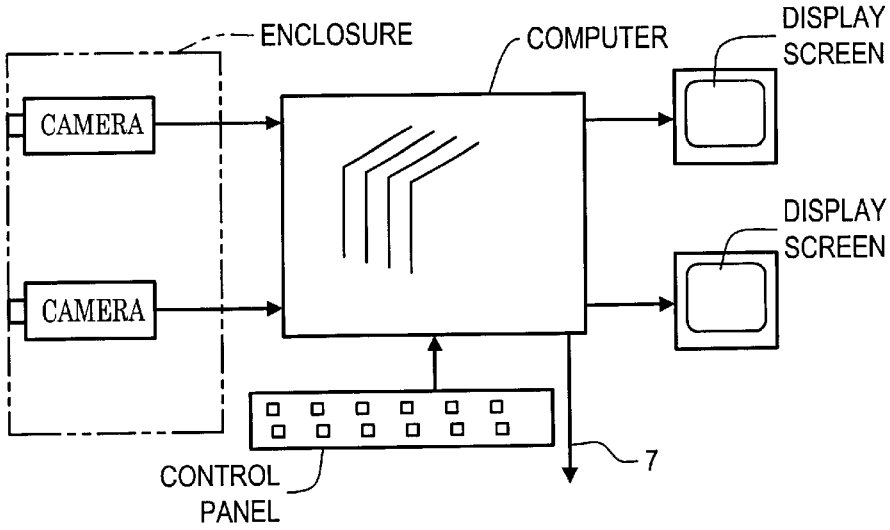
FIG. 1 is a block diagram of the device.

The device for monitoring an enclosure 2, such as the hold of an aircraft according, to the invention comprises, as shown in FIG. 1, a certain number of camera blocks 3 situated in the enclosure 2, so as to cover the entire volume thereof, which are linked to one and the same computer 4, this computer 4 itself being connected to a control panel 5 and to display screens 6, and comprising an output 7 to alarms.

Figure 2:
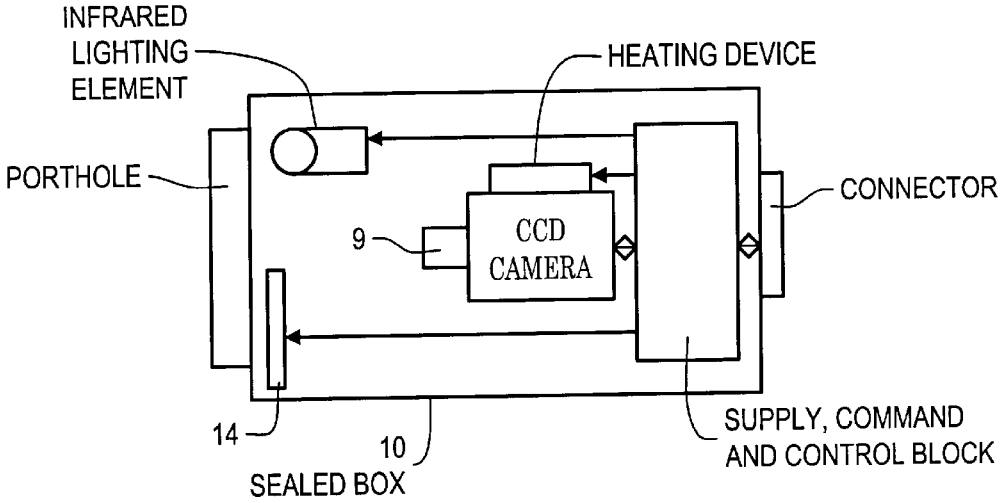
FIG. 2 is a diagrammatic view of a camera and of its environment.

As shown in FIG. 2, each camera block 3 contains a CCD camera 8 of very short spectral band lying between 0.4 $\mu$m and 1.1 $\mu$m, fitted with an infrared filter 9 eliminating the spectral band lying between around 0.4 $\mu$m and 0.8 $\mu$m. This camera is housed inside a sealed box 10, blanked off by a porthole 12, allowing the camera 8 to capture images. The box 10, filled with an inert gas, is fitted with a heating device 13 ensuring temperature regulation and with a device 14 for de-icing the porthole 12. Inside the box 10 is also housed a near infrared lighting element 15, for example an 880 nm silicon lighting. The box 10 also contains a supply, command and control block 16 for the camera, for the lighting, for the heating and for the de-icing. A connector 17 makes it possible to effect the link between this camera block 3 and the computer 4.

Figure 3:
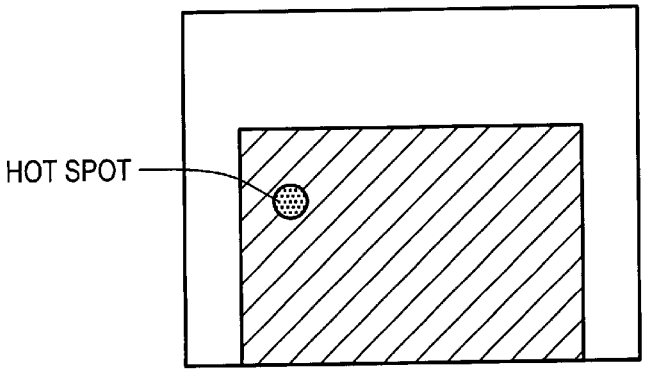
FIGS. 3 to 7 are views of images and of histograms portraying the mode of detection of a certain number of phenomena by this device.

Given these features, each camera can carry out various types of detection. Thus, as shown in FIG. 3, the camera can act as a thermographic detector, detecting a hot spot 18, by graphical overlay on the image displayed.

Figure 4:
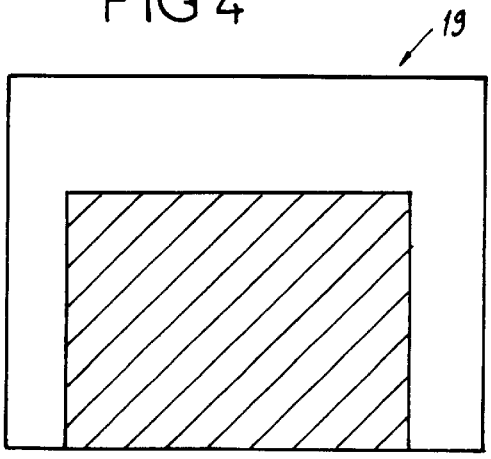
Figure 5:
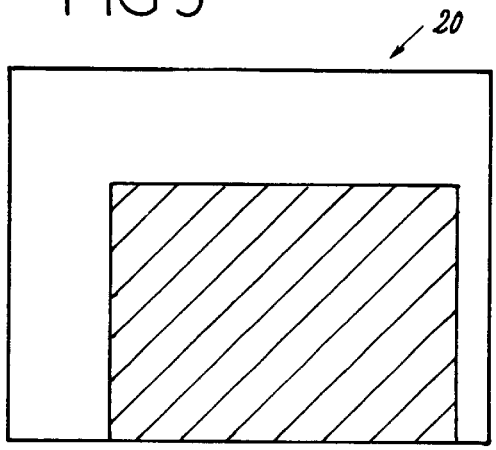

This type of camera can also detect shifts of load. It is necessary to capture a first image 19, represented in FIG. 4, in which the load occupies a reference position. Thereafter, it is possible to take snapshots corresponding to those which deliver the image 19 which is the reference image, the image 20 thus obtained being compared with the reference image so as to detect any variations in the position of the load—see FIG. 5.

Figure 6:
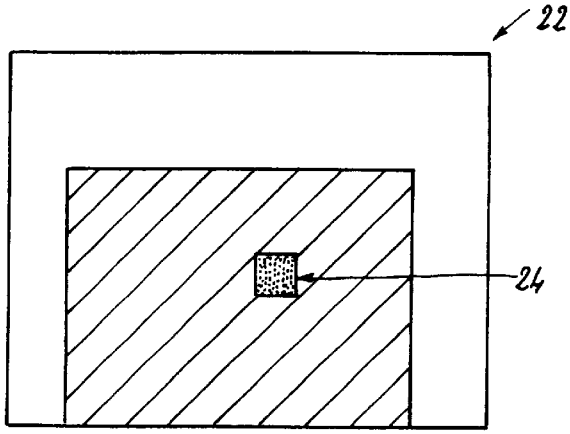
Figure 7:
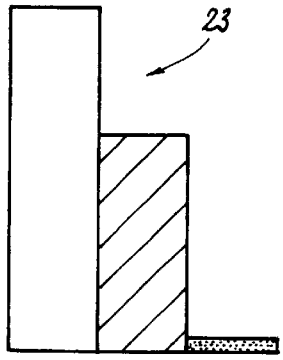

FIG. 6 represents an image 22 and FIG. 7 a histogram 23 of the image 22. The presence of fire in the image 22 is manifested as a zone 24 of high luminosity (saturation phenomenon). To detect the appearance of such a phenomenon, the histogram 23 of the grey levels is used, which makes it possible to ascertain the distribution of the grey levels of the image. Detection is triggered on a threshold with counting of the points or pixels having a level higher than the threshold and forming a certain number of contiguous points. The processing here also comprises an analysis of the spatio-temporal variations of the flame (frequency of appearance of the grey levels, and its evolution).

The detection of smoke is based on the pinpointing within the image, with lighting, of an increasing luminosity related to the opacity of the smoke.

A hygrometric sensor (not represented in the drawing) placed in the enclosure 2 makes it possible to discriminate between fog and smoke.

As is apparent from the foregoing, the invention affords a great improvement over the existing technique by providing a device for monitoring the inside of an enclosure 2, making it possible to perform various types of detection with the aid of a single type of sensor. Whereas n sensors 3 are used, these n sensors are managed by one and the same computer 4.

The advantage of this sensor 3 is that it consists of a standard camera 8, which is very sensitive in the near infrared and with which is associated a lighting element 15 which is insensitive to pressure and temperature, the whole being placed in a sealed box 10.

The monitoring device, which is the subject of the invention, also has the advantage of comprising, in addition to the sensor or sensors, all the logic for detecting physical measurement of the phenomena, and for tracking these phenomena. This device can furthermore test all the functions of the sensor or sensors.

What is claimed is:

1. Device for monitoring an enclosure, comprising: at least one sensor located to monitor the enclosure, the sensor comprising a CCD camera of very short spectral band lying between 0.4 $\mu$m and 1.1 $\mu$m, fitted with an infrared filter eliminating the spectral band lying between around 0.4 $\mu$m and 0.8 $\mu$m, this sensor being associated with an image processing computer having a display screen and a control board.

2. Device according to claim 1, characterized in that each camera is associated with a near infrared lighting element.

3. Device according to claim 2, characterized in that the lighting element is an 880 nm silicon element.

4. Device according to claim 2, characterized in that each camera and the associated lighting element are housed inside a sealed box closed by a porthole.

5. Device according to claim 4, characterized in that the box also contains a temperature-regulating device and/or a device for de-icing the porthole, as well as a supply, command and control block.

6. Device according to claim 2, characterized in that the computer brings about the lighting of each lighting element for durations of between around 40 and 100 milliseconds.

7. Device according to claim 1, characterized in that it compares two images, one of which constitutes a reference image, which are acquired successively so as to detect variations in the position of the objects lying in the field of each camera.

8. Device according to claim 1, characterized in that it analyses the histogram of the grey levels of an image provided by a camera with counting of the points having a level higher than a predetermined threshold and forming a connected region of the image, so as to deduce therefrom the existence and the extend of a zone of fire.

9. Device according to claim 8, characterized in that it performs a discrimination interfering phenomena, such as those resulting from the sun or from an incandescent lamp.

10. Device according to claim 1, characterized in that it analyses the distribution of the gray levels as well as the number of classes present in each image delivered by a camera so as to detect the possible presence of smoke.

11. Device according to claim 10, characterized in that it comprises a hygrometric sensor situated in the enclosure, for discrimination between fog and smoke.

12. Device according to claim 10, characterized in that the fog/smoke discrimination is carried out by analyzing the spatio-temporal gradient of diffusion.

13. Device according to claim 1, characterized in that the computer is linked to at least one alarm to which a signal is delivered upon detection of an anomaly.

14. Device according to claim 1, where the enclosure includes the hold of an aircraft.

15. Device for monitoring an enclosure, in particular the hold of an aircraft, characterized in that it (1) comprises at least one sensor comprising a CCD camera of very short spectral band lying between 0.4 $\mu$m, fitted with an infrared filter eliminating the spectral band lying between around 0.4 $\mu$m and 0.8 $\mu$m, this sensor being associated with an image processing computer having a display screen and a control board, (2) compares two images, one of which constitutes a reference image, which are acquired successively so as to detect variations in the position of the objects lying in the field of view of each camera, (3) analyzes a histogram of the grey levels of an image provided by a camera with counting of the points having a level higher than a predetermined threshold and forming a connected region of the image, so as to deduce therefrom the existence and the extend of a zone of fire, and (4) analyzes a distribution of the gray levels as well as the number of classes present in each image delivered by a camera so as to detect the possible presence of smoke.

* * * * *